United States Patent [19]

Maeda

[11] 4,364,680

[45] Dec. 21, 1982

[54] INK RIBBON FEEDER

[75] Inventor: Katsumi Maeda, Shizuoka, Japan

[73] Assignee: Star Seimitsu Kabushiki Kaisha, Japan

[21] Appl. No.: 145,493

[22] Filed: May 1, 1980

[30] Foreign Application Priority Data

May 2, 1979 [JP] Japan ..... 54-54539

[51] Int. Cl.[3] ..... B41J 35/50

[52] U.S. Cl. ..... 400/220.1

[58] Field of Search ..... 400/220, 220.1

[56] References Cited

U.S. PATENT DOCUMENTS

| | | | |
|---|---|---|---|
| 2,122,518 | 7/1938 | Deane et al. | 400/220 |
| 2,300,755 | 11/1942 | Williams | 400/220 |
| 2,906,203 | 9/1959 | Grosse | 400/220 |
| 2,978,090 | 4/1961 | Brandt | 400/220.1 |
| 3,542,183 | 11/1970 | Stiffler | 400/220.1 |
| 3,882,989 | 5/1975 | Morelli | 400/220 |
| 3,899,065 | 8/1975 | Brignole | 400/220.1 |
| 3,910,399 | 10/1975 | Shimodaira | 400/220.1 |
| 3,976,185 | 8/1976 | Aebi | 400/220 |
| 4,214,838 | 7/1980 | Gassowski | 400/220.1 |

FOREIGN PATENT DOCUMENTS

| | | | |
|---|---|---|---|
| 636700 | 10/1936 | Fed. Rep. of Germany | 400/220 |
| 682804 | 11/1939 | Fed. Rep. of Germany | 400/220.1 |

*Primary Examiner*—William Pieprz

*Attorney, Agent, or Firm*—Robert E. Burns; Emmanuel J. Lobato; Bruce L. Adams

[57] ABSTRACT

An ink ribbon feeder having a pair of rotatable ratchet wheels for driving ribbon spools. A control member rockable toward either ratchet wheel carries a ratchet wheel drive member movable on the control member for driving a respective one of the ratchet wheels to which the control member has been rocked. When ribbon from a spool has run out so that ribbon tension prevents further driving of a particular ratchet wheel, the control member rocks toward the other ratchet wheel to bring the ratchet wheel drive member into position to drive the other ratchet wheel and feed the ribbon in a reverse direction.

4 Claims, 7 Drawing Figures

INK RIBBON FEEDER

FIELD OF THE INVENTION

The invention relates to an ink ribbon feeder used in a printing apparatus such as a printer of impact type or typewriter, and more particularly, to an ink ribbon feeder which automatically changes an ink ribbon feed between the forward and the reverse direction.

A tape feeder is extensively used in a printer of impact type of typewriter which has a pair of ribbon spools to feed an ink ribbon from one of the ribbon spools to the other for each printing operation or each time one line is printed and which is provided with a reversing mechanism so that when the supply of the ink ribbon on the supply spool is exhausted, a switching mechanism is automatically operated to drive the ribbon spool which has been used as the supply side so that the ink ribbon is fed in the reverse direction. To switch the direction in which the ink ribbon is fed, means may be provided which detects the diameter of a roll of ink ribbon on the ribbon spool so that the end of the ink ribbon of the roll may be detected to switch the rotating drive to the other spool. Alternatively, the opposite ends of the ink ribbon may be anchored to the respective ribbon spools, and the ink ribbon is fed from one of the spools to the other until the end of the ink ribbon is reached, whereupon the tension in the ink ribbon disables the rotation of the both spools. By detecting the termination of rotation of the spools, a rotating drive may be applied to the other spool. The usual feeding techniques can be categorized into these two schemes. The invention relates to a tape feeder which operates on the principle of the latter technique.

DESCRIPTION OF THE PRIOR ART

An ink ribbon feeder is known in which when the end of an ink ribbon is reached, the tension in the ribbon is utilized to prevent a further rotation of ribbon spools and the cessation of rotation in turn initiates a ribbon feed in the reverse direction, as disclosed in Japanese Utility Model Publication No. 55-14,530. This ink ribbon feeder comprises a pair of spaced sprocket wheels mounted on a baseplate. A first elongate slot is formed in the baseplate intermediate the both wheels which extends in a direction perpendicular to a line joining the axes of the wheels. A connecting pin is loosely fitted in the slot, and has its lower end connected to a drive lever which is rotated below the baseplate. The drive lever extends in a direction parallel to the above line, and has its one end pivotally mounted on the baseplate. The upper end of the connecting pin extends through a transversely elongate slot formed in a feed pawl lever disposed on the baseplate intermediate the ratchet wheels and is fixedly connected to a transmission bar intermediate its ends. At its front end, the feed pawl lever is formed with feed pawls on its opposite sides, which selectively engage teeth on the pair of ratchet wheels. The transmission bar and an anti-reversing pawl lever are mounted on the feed pawl lever, with the rear end of the transmission bar being pivotally connected to the rear end of the feed pawl lever. On its front end, the transmission bar carries a guide pin which extends upright from the upper surface thereof, which guide pin engages a second longitudinally elongate slot formed in the anti-reversing pawl lever. The anti-reversing pawl lever has its rear end pivotally mounted on the baseplate while its front end is formed with anti-reversing pawls on the opposite sides thereof which selectively engage the teeth on the pair of ratchet wheels to prevent a reversing of the wheels. At its front end, the anti-reversing pawl lever is centrally connected with one end of a first spring which is Ω-shaped. The other end of the first spring is connected to the baseplate on a perpendicular bisector to the line which joins the axes of the pair of ratchet wheels. A second, similar spring is disposed between the front end of a drive lever at the center thereof and an anchorage pin located on the perpendicular bisector. The anchorage pin extends through a third longitudinally elongate slot formed in the baseplate, and is attached to the underside of the front end of the feed pawl lever at the center thereof. A normal ink ribbon feed operation takes place by applying a drive to the free end of the drive lever in a direction toward the ratchet wheel, thereby locating the pin at the rear end of the first slot. The movement of the pin causes the transmission bar to move rearwardly within the second slot. The movement of the transmission bar in turn causes a rearward movement of the feed pawl lever which has its rear end connected to the rear end of the transmission bar. In this manner, one of the ratchet wheels which engages the feed pawl is caused to rotate. The ribbon spool which is disposed on the ratchet wheel thus driven takes up the ink ribbon, and when the end of the ribbon is reached upon the supply spool, the both spools are prevented from rotating as are the ratchet wheels. Under this condition, any drive applied to the drive lever cannot cause a rearward movement of the connecting pin, and hence the rear end of the feed pawl lever oscillates about the feed pawl which is engaged with the ratchet wheel, in a direction toward other ratchet wheel. This oscillating motion is allowed by the presence of the transversely elongate slot formed in the feed pawl lever. The oscillating motion causes the rear end of the transmission bar to oscillate in the same direction, whereby the guide pin on the transmission bar oscillates toward the other ratchet wheel. As the guide pin oscillates, the front end of the anti-reversing lever moves in an interlocked manner while compressing the first spring. When the guide pin moves past the perpendicular bisector, the resilience of the first spring causes the front end of the transmission bar and the anti-reversing lever to be located toward the other ratchet wheel by a snap action. When the anti-reversing lever oscillates toward the other ratchet wheel, the guide pin also moves toward the other ratchet wheel, whereby the rear end of the transmission bar moves toward said one ratchet wheel, accompanying the rear end of the feed pawl lever. The movement of the rear end of the feed pawl lever causes the front end of the feed pawl lever to oscillate about the connecting pin toward the other ratchet wheel. When the end of the second spring which is located nearer the feed pawl lever moves past the perpendicular bisector, its resilience causes the front end of the feed pawl lever to move toward the other ratchet wheel by a snap action, thus terminating a reversing operation.

In the ink ribbon feeder described, the snap action which is produced by the pair of springs is relied upon to switch the feed pawl lever and the anit-reversing lever. Hence, the choice of the resilience of these springs has a significant influence upon the switching operation. If the resilience is increased, the snap action takes place more reliably, but the resilience of the springs acts most strongly at the neutral point where one end of each spring located nearer the anti-reversing lever and the feed pawl lever is located on the perpendicular bisector. Hence, a force must be applied to the anti-reversing lever and the feed pawl lever which overcomes the resilience to move them past the neutral point. However, since the force applied to these levers is transmitted through a fulcrum defined by the point of engagement between the feed pawl and one of the teeth on the ratchet wheel which engages therewith, the increased force is applied to this fulcrum. This imposes an undue rotating effort to the ratchet wheels, which inturn produces an increased tension in the ink ribbon, possibly causing a damage or an elongation of the ink ribbon. Conversely, if the resilience of the springs is reduced, there is a likelihood that a switching operation may take place inadvertently when the load on the ratchet wheels increases to retard the rotation thereof during a normal ribbon feed operation.

SUMMARY OF THE INVENTION

It is an object of the invention to provide an ink ribbon feeder provided with a reversing mechanism which is capable of eliminating the described disadvantages of a conventional arrangement.

It is another object of the invention to provide an ink ribbon feeder which is simple in construction and which is capable of providing a positive switching in response to a drive of a reduced magnitude without producing undue loading on ratchet wheel.

In accordance with the invention, there is provided an ink ribbon feeder for causing a reciprocating movement of an ink ribbon between a pair of spools, comprising a baseplate, a pair of ratchet wheels rotatably mounted on the baseplate for driving the spools, a control member located intermediate the pair of ratchet wheels and supported on the baseplate so as to be movable in a direction perpendicular to a line joining the axes of the pair of ratchet wheels and so as to permit one end thereof to be rockable toward either ratchet wheel, a ratchet wheel drive member carried by one end of the control member, the drive member having one end which is disposed centrally in one end of the control member so as to be rockable and so as to be movable in a direction toward the other end of the control member, the other end of the drive member selectively engaging with one of teeth on one of the ratchet wheels and being formed with an engaging element which causes said one ratchet wheel to rotate whenever it moves in said direction together with the control member, a resilient member having its one end connected to a central portion of the other end of the drive member and its other end connected to a central portion of the other end of the control member, thereby urging the ratchet wheel drive member toward the other end of the control member, a switching lever having a pair of anti-reversing pawls on one end thereof which selectively engage one of teeth on the pair of ratchet wheels to prevent a reverse rotation of the engaged ratchet wheel, the switching lever being pivotally mounted on the baseplate intermediate its end, one end of the switching lever carrying said one end of the control member so as to be movable in said direction and so as to be rockable whenever the control member rocks in the same direction as the rocking motion of the control member, means on the other end of the switching lever for selectively urging said one end of the switching lever toward one of the ratchet wheels, said urging means acting, whenever the center of said one end of the switching lever has rocked toward either ratchet wheel from a line which perpendicularly intersects with said first mentioned line at a point midway between the pair of ratchet wheels, to cause said one end of the switching lever to rock toward the ratchet wheel a drive member for moving the control member in said direction, and means for driving the drive member to urge the control member in one direction, the engaging element of the drive member being engaged with one of the ratchet wheels when the urging means urges the control member in said one direction.

According to a preferred embodiment of the invention, a guide prove is formed in the baseplate along a line which perpendicularly intersects with another line joining the axes of the pair of ratchet wheels at a point substantially midway therebetween. A guide pin is loosely fitted in the guide groove, and rotatably carries one end of the control member, allowing a translational and rocking motion of the latter. An upright pin is fixed on the other end of the control member and fits in an elongate slot formed in one end of the ratchet wheel drive member. The elongate slot permits the control member to move independently from the ratchet wheel drive member. Consequently, when the end of the ink ribbon is reached to cease the rotation of the ratchet wheel, and when the control member is moved along the guide groove, the control member initially moves through a distance corresponding to the length of the elongate slot. During such movement, a drive of a magnitude which is slightly greater than the drive applied during a normal ink ribbon feed operation is applied to the point of engagement between one of the teeth on the ratchet wheel and the ratchet wheel drive member. Therefore, if the ratchet wheel temporarily fails to rotate as a result of an increased load on the ribbon pulley, the increased drive forcibly rotates the ratchet wheel, thus avoiding a reversing of the direction in which the ink ribbon is fed in response to the cessation of rotation other than that caused by the end of the ink ribbon being reached. When the rotation ceases as the end of the ink ribbon is reached, the application of the increased drive cannot cause rotation of the ratchet wheel, so that the ratchet wheel drive member rocks about its point of abutment against the ratchet wheel, as a fulcrum, toward the other ratchet wheel under the resilience of a tension spring. The rocking motion is transmitted through the upright pin to the control member, which also rocks about the guide pin, thereby rocking the switching lever toward the other ratchet wheel. The switching lever is pivotally mounted on the underside of the baseplate intermediate its ends where a fulcrum is defined. The other end of the switching lever is connected to one end of a bias spring, the other end of which is anchored to the baseplate in a manner such that its biasing force is at its maximum when said one end of the switching lever is located at a position midway between the pair of ratchet wheels. Consequently, if one end of the switching lever is slightly offset toward wither ratchet wheel from its position which is midway between the pair of ratchet wheels, the switching lever subsequently continues to rock under the action of the bias spring.

DESCRIPTION OF PREFERRED EMBODIMENT

Figure 1:
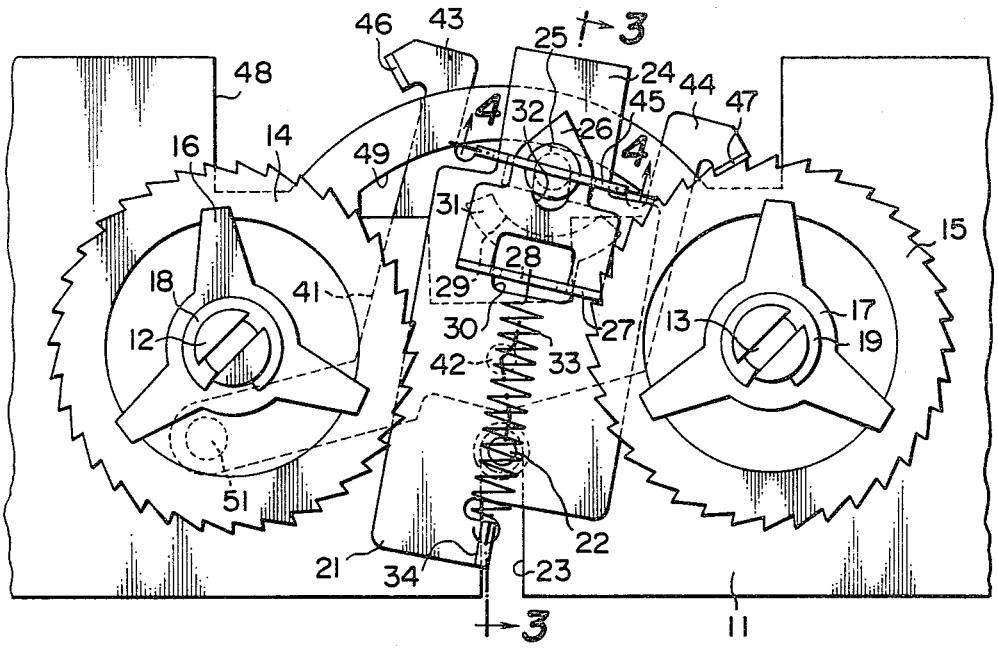
FIG. 1 is a plan view of an ink ribbon feeder according to one embodiment of the invention.

Referring to FIG. 1, there is shown a baseplate 11 on which a pair of ribbon spool shafts 12, 13 are fixedly mounted in spaced relationship from each other. The top of each ribbon spool shaft 12, 13 is forked in order to support ink ribbon spools, not shown, in a coaxial, firm and rotatable manner and against unintended disengagement. A pair of ratchet wheels 14, 15 and a pair of spring abutment members 16, 17 are rotatably mounted on the ribbon shafts 12, 13, respectively, and held in place by E-rings 18, 19. A spacer, not shown, having a diameter which is slightly greater than the spool shafts 12, 13 are fitted thereon to space the ratchet wheels 14, 15 from the baseplate 11. The spring abutment members 16, 17 represent frictional transmission members which transmit the rotation of the ratchet wheels 14, 15 to their associated ribbon spools in a reliable manner. Intermediate the pair of spool shafts 12, 13, a control member 21 is placed on the baseplate 11 and extends from the front end of the baseplate 11, or the lower side as viewed in FIG. 1, to the rear end of the upper side, as viewed in FIG. 1. In the description to follow, the term "front end" or "front" refers to the lower side while the "rear end" or "rear" refers to the upper side, as viewed in FIG. 1.

Toward the front end of the control member 21, a guide pin 22 has its one end mounted on the underside thereof, and has its other end extending through a guide groove 23 to project below the lower surface of the baseplate 11. The guide groove 23 extends from the front end toward the rear end of the baseplate 11 along a line which is substantially perpendicular to a line joining the axes of the pair of spool shafts 12, 13 and intersects therewith at a point midway therebetween. The rear end of the control member 21 is provided with an extention 24 of a reduced width, and adjacent to the boundary between the extension 24 and the remainder of the control member 21, an upright pin 25 is fixedly mounted thereon centrally crosswise thereof. A ratchet wheel drive member 26 is placed on the control member 21, and includes a ratchet wheel drive pawl 27 which is formed by a vertically upstanding portion thereof which is integral with the front end thereof.

As shown in FIG. 1, the drive pawl 27 has its right-hand end engaged with one of the teeth on the ratchet wheel 15 when the control member 21 has rocked toward the ratchet wheel 15, and has its left-hand end engaged with one of the teeth on the ratchet wheel 14 when the control member 21 has rocked in the opposite direction, namely, toward the ratchet wheel 14. A projection 28 is formed centrally on the lower end of the drive pawl 27, and loosely fits in a substantially Y-shaped slot 31 formed in the control member 21 and including an arcuate slot 29 and a rectilinear slot 30 which extends forwardly from the middle portion of the arcuate slot 29. Toward the rear end, the drive member 26 is formed with a slot 32 which is elongate in the fore-and-aft direction and in which the upright pin 25 on the control member 21 is loosely fitted. When the upright pin is located against the front end of the slot 32, the projection 28 is situated within the rectilinear slot while when the upright pin 25 is located against the rear end of the slot 32, the projection 28 is situated within the arcuate slot. A coiled spring 33 has its one end engaged with the central portion of the drive pawl 27, and has its other end anchored to an upstanding piece 34 which is cut from the front end of the control member 21 at the central portion thereof. The coiled spring 33 normally urges the drive member 26 forwardly so that the pawl 27 can be accurately brought into abutment against one of the pawls of the ratchet wheels 14, 15.

Figure 2:
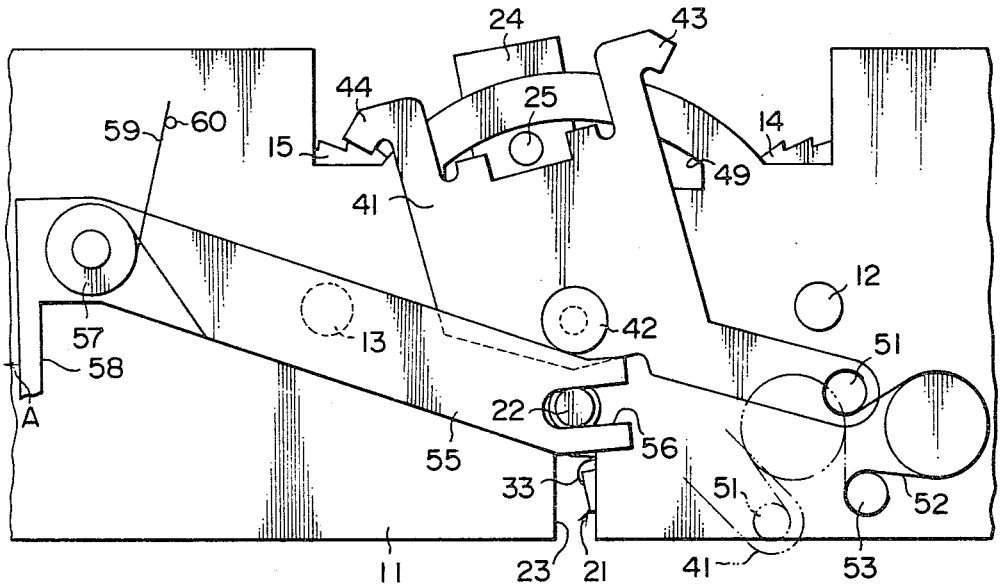
FIG. 2 is a bottom view of the feeder shown in FIG. 1.
Figure 3:
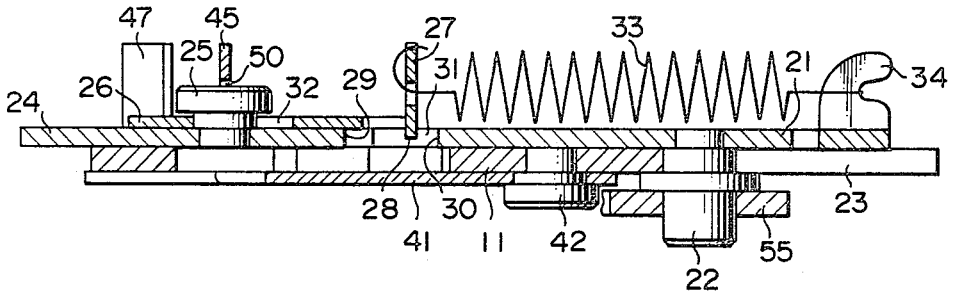
FIG. 3 is a longitudinal section taken along the line 3—3 shown in FIG. 1.
Figure 4:
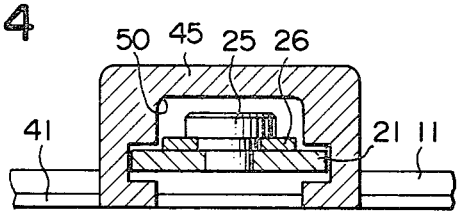
FIG. 4 is a transverse section taken along the line 4—4 shown in FIG. 1.

Referring to FIG. 2, a switching lever 41 which selectively drives the ratchet wheels 14, 15 is mounted on the underside of the baseplate 11, and is pivotally mounted on a pivot pin 42 extending from the underside of the baseplate 11 in its middle portion. It is to be noted that the pivot pin 42 is located substantially midway between the pair of spool shafts 12, 13. The upper end of the switching lever 41 is formed with a pair of anti-reversing arms 43, 44 and a guide 45 associated with the control member 21. An anti-reversing pawl 46 which extends vertically upward is formed on the free end of the arm 43 while an anti-reversing pawl 47 is similarly formed on the free end of the arm 44, both in an integral manner with the arms. The anti-reversing pawl 46 engages with one of the teeth on the ratchet wheel 14 to prevent a counter-clockwise rotation thereof, as viewed in FIG. 1, whenever the switching lever 41 rocks about the pivot pin 42 toward the ratchet wheel 14. Similarly, the anti-reversing pawl 47 engages with one of the teeth on the ratchet wheel 15 to prevent a clockwise rotation of the ratchet wheel 15 whenever the switching lever 41 rocks toward the ratchet wheel 15, as shown in FIG. 1. To provide such rocking motion of the switching lever 41, the upper edge, as viewed in FIG. 1, of the baseplate 11 is centrally formed with a notch 48, through which the anti-reversing pawls 46, 47 project above the baseplate 11. The guide 45 on the switching lever 41 associated with the control member extends through a substantially T-shaped guide slot 49 formed in the baseplate 11 to project above the latter. In its region above the baseplate 11, the guide 45 is formed with a slit 50 (see FIGS. 3 and 4) which permit the control member 21 and the drive member 26 to pass therethrough. On its other end, the switching lever 41 fixedly carries a pin 51 on its underside, which pivotally receives one end of a spring 52, the other end of which is similarly pivotally mounted on a pin 53 secured to the underside of the baseplate 11 intermediate the front end thereof and the spool shaft 12.

The spring 52 is a coiled spring, and resiliently urges the switching lever 41 so that the anti-reversing pawl 47 firmly engages one of the teeth on the ratchet wheel 15 whenever the switching lever 41 assumes its position shown in FIGS. 1 and 2, and also resiliently urges the switching lever 41 so that the anti-reversing pawl 46 firmly engages with one of the teeth on the ratchet wheel 14 whenever the switching lever 41 rocks in the opposite direction from the position shown, namely, when the end of the switching lever 41 carrying the pin 51 rocks to its phantom line position shown in FIG. 2. In addition, when the center of the guide 45 is offset toward the ratchet wheel 15 from the central position which lies on an extension of the line joining the axes of the pivot pin 42 and the guide pin 22, the spring 52 resiliently urges the pin 51 upward to rock the switching lever 41 toward the ratchet wheel 15. Conversely, when the center of the guide 45 is offset to the opposite side of the extension which is toward the ratchet wheel 15, the spring 52 resiliently depresses the pin 51 to rock the switching lever 41 toward the ratchet wheel 15. Hence, when it is desired to change the switching lever 41 from its position toward the ratchet wheel 15 to its other position toward the ratchet wheel 14, it is only necessary that a rocking force be applied to the switching lever 41 which is of a magnitude to displace the center of the guide 45 to the other side of the above extension, whereupon the resilience of the spring 52 enables a continued rocking motion of the switching lever 41.

As shown in FIG. 2, the guide pin 22 which projects below the underside of the baseplate 11 is loosely fitted in an elongate slot 56 formed in one end of a drive lever 55 which is substantially L-shaped and which is pivotally mounted on a pivot pin 57 at the bend thereof. The pivot pin 57 is fixedly mounted on the underside of the baseplate 11. The other end 58 of the drive lever 55 is adapted to receive an external drive in a direction indicated by an arrow A in FIG. 2. A return spring 59 associated with the drive lever 55 is disposed on the pivot pin 57, and has its one end anchored to the drive lever 55 and its other end anchored to a pin 60 which is secured to the underside of the baseplate 11. The return spring 59 resiliently biases the drive lever 55 so that said one end thereof is normally located adjacent to the rear end of the guide slot 23.

Figure 5:
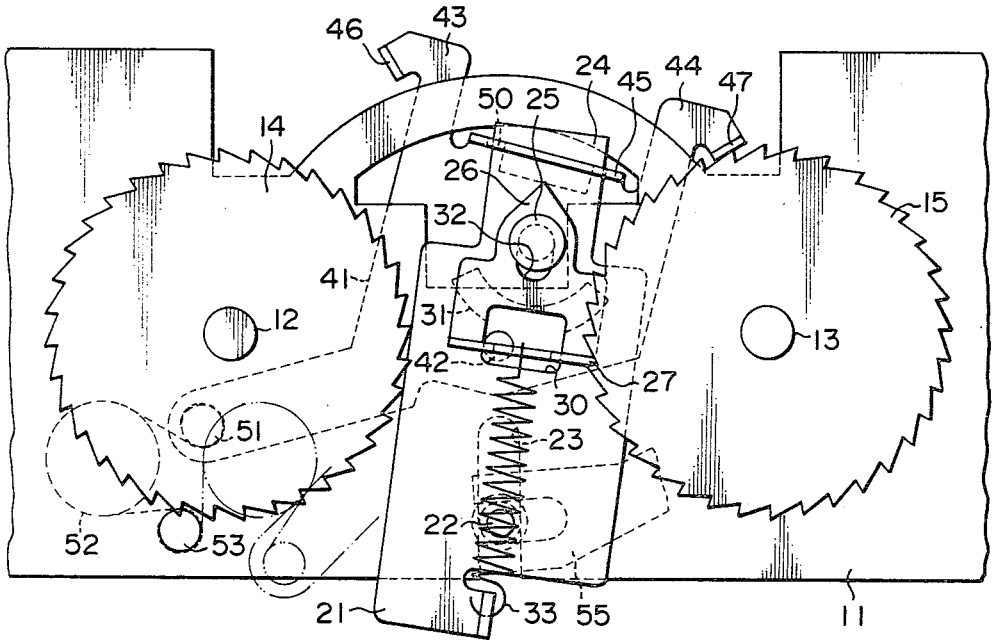
FIGS. 5 and 6 are plan views which illustrate the operation of the ribbon feeder.

In operation, it is assumed that the apparatus is initially in the condition shown in FIGS. 1 and 2. When a drive is applied to the end 58 of the drive lever 55 in a direction indicated by the arrow A at the termination of each printing operation or printing of each line, said one end of the lever 55 is driven forward about the pivot pin 57. The angular movement of the lever 55 causes the guide pin 22 which is fitted into the elongate slot 56 to move forwardly along the guide slot 23, as shown in FIG. 5. Since the control member 21 is located on the opposite or upper side of the baseplate 11 and is connected with the guide pin 22, the control member 21 also moves forwardly. The drive pawl 27 on the drive member 26 which is placed on the control member 21 is engaged with one of teeth on the ratchet wheel 15, and causes the ratchet wheel to rotate counter-clockwise when the drive member 26 moves forwardly in response to the forward movement of the control member 21. Since the drive member 26 is biased by the coiled spring 33 to move forward and the projection 28 is situated within the rectilinear slot 30, the drive member 26 rocks about the upright pin 25 without disengaging from the tooth on the ratchet wheel 15, and moves forwardly while maintaining such engagement, whereby the ratchet wheel 15 is positively rotated counter-clockwise.

When the drive member 26 rocks from its position shown in FIG. 1 to its position shown in FIG. 5, the ratchet wheel 15 has rotated through an angular increment corresponding to twice its tooth pitch. During such angular movement, the anti-reversing pawl 47 on the switching lever 41 moves past two teeth on the ratchet wheel 15 to engage the third tooth against the resilience of the torsion spring 52. when the drive is no longer applied to the end 58 of the drive lever 55, the spring 59 returns the drive lever 55 to its position shown in FIG. 2, by causing it to turn back about the pivot pin 57. When the drive lever 55 returns to its original position, the control member 21 also returns to its position shown in FIG. 1. At this time, the drive pawl 27 slides over the teeth of the ratchet wheel 15. During this process, the drive pawl 27 imparts a clockwise rotating force to the ratchet wheel 15, which however is prevented from rotating clockwise by the presence of the anti-reversing pawl 47.

Each time a drive is applied to the drive lever 55, the described operation is repeated. The rotation of the ratchet wheel 15 is effective to take up the ink ribbon from the ribbon pulley on the ratchet wheel 14 to the ribbon pulley on the ratchet wheel 15. Assuming that the opposite ends of the ink ribbon are secured to the respective pulleys, when the end of ribbon on the ribbon pulley fitted over the supply ratchet wheel 14 is reached, the ribbon pulley on the ratchet wheel 15 becomes unable to rotate, and the ratchet wheel 15 also cannot rotate if a drive is applied to the take-up ratchet wheel 15 through the drive member 26. A reversing operation is initiated at this point, and will be described below.

Figure 6:
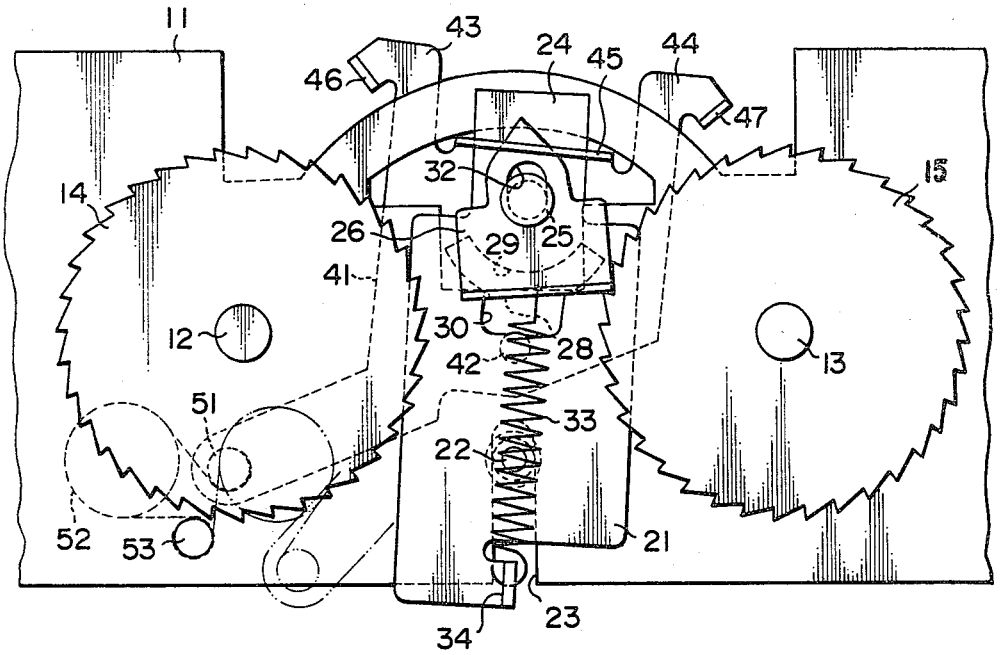

When the ratchet wheel 14 can no longer rotate because the end of the ink ribbon is reached, a drive is applied to the end 58 of the drive lever 55, causing the guide pin 22 thereon to move forwardly along the guide slot 23. The control member 21 then also moves forwardly. The drive member 26 located on the control member 21 also tends to move forward together with the control member 21, but cannot move forwardly since the rotation of the ratchet wheel 15 is inhibited. Hence, only the control member 21 moves forward against the resilience of the coiled spring 33. In response thereto, the upright pin 25 thereon is located on the front end of the slot 32 in the drive member 26. On the other hand, the projection 28 which projects downwardly from the bottom of the drive pawl 27 moves out of the rectilinear slot 30, and is situated within the arcuate slot 29. Since one end of the drive pawl 27 is maintained in engagement with one of the teeth on the ratchet wheel 15, and the projection 28 is situated within the arcuate slot 29, the resilience of the coiled spring 33 is effective to rock the drive member 26 about the point of its engagement with the ratch wheel 15 toward the ratchet wheel 14, as illustrated in FIG. 6. The rocking motion of the drive member 26 is transmitted through the upright pin 25 to cause the control member 21 to rock in the same direction, whereby the control member 21 causes its extension 24 to rock about the guide pin 22 toward the ratchet wheel 14. Since the extension 24 is fitted in the slit 50 formed in the guide 45 of the switching lever 41, the rocking motion of the extension 24 causes the switching lever 41 to rock about the pivot pin 42 whereby the anti-reversing arms 43, 44 move toward the ratchet wheel 14. It is only necessary that such rocking motion takes place to an extent that the center of the extension 24 is offset from the line joining the axes of the pins 22, 42 toward the ratchet wheel 14. The resilience of the spring 52 subsequently brings the switching lever 41 to its operative position associated with the ratchet wheel 14. Since the switching lever 41 and the control member 21 are connected together by the guide 45, the control member 21 is also moved toward the ratchet wheel 14, whereby the drive pawl 27 on the drive member 26 engages with one of the teeth on the ratchet wheel 14 and the anti-reversing pawl 46 also engages with one of the teeth thereof. Thereafter, the ratchet wheel 14 rotates clockwise to take up the ink ribbon from the ribbon pulley on the ratchet wheel 15 onto the ribbon pulley on the ratchet wheel 14 each time a drive is applied to the end 58 of the drive lever 55 as indicated by the arrow A.

In the embodiment described above, the spring 52 is interposed between the pin 51 on one end of the switching lever 41 and the pin 53 secured to the underside of the baseplate 11 to urge two pins 51, 53 in opposite directions to thereby achieve an engagement between the anti-reversing pawls 46, 47 and the ratchet wheels 14, 15, and to enable the switching lever 41 to be rocked toward the other ratchet wheel whenever it has rocked about the pivot pin 42 to the neutral point where the center of the extension 24 of the control member 21 is offset toward the other ratchet wheel from the extension of the line joining the axes of the pins 22, 42. When the switching lever 41 is located on the neutral point, the spring 52 urges the two pins 51, 53 in opposite directions with increased resilient force while the resilient force is reduced when one of the anti-reversing pawls 46, 47 is engaged with one of the ratchet wheels. In an embodiment shown in FIG. 7, an arrangement is made such that the greatest resilient force is applied to the switching lever 41 when the anti-reversing pawl is engaged with one of the ratchet wheels.

Figure 7:
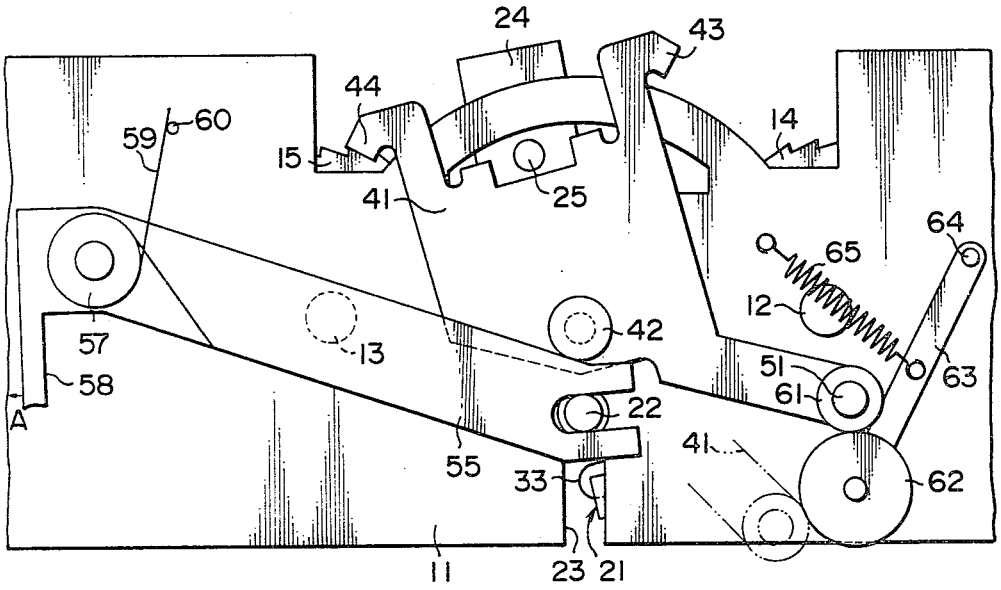
FIG. 7 is a bottom view of another form of a mechanism which supports the switching lever.

Specifically, a cylindrical member 61 is fitted over the pin 51 on the switching lever 41, and the peripheral surface of the member 61 is maintained in engagement with the peripheral surface of a rotatable roller 62 which is rotatably mounted on one end of a pivotable arm 63, the other end of which is in turn pivotally mounted on a pivot pin 64 which is located adjacent to the spool shaft 12. A coiled spring 65 has its one end connected to the middle portion of the pivotable arm 63 and its other end anchored to the baseplate 11. The spring 65 normally urges the end of the pivotable arm 63 carrying the rotatable roller 62 upward in a resilient manner. As shown in FIG. 7, the axis of the cylindrical member 61 is located to the upper of the axis of the rotatable roller 62. When the extension 24 of the control member 21 causes the switching lever 41 to rock about the pivot pin 42 from its position adjacent to the ratchet wheel 15 to its position adjacent to the ratchet wheel 14, as shown in FIG. 7, the cylindrical member 61 urges the rotatable roller 62 to the right while rotating it counterclockwise. When the extension 24 assumes the center position, the rotatable roller 62 is displaced to its maximum extent. At this time, the coiled spring 65 exhibits its maximum elongation. However, if the extension is offset toward the ratchet wheel 14 from the center position even slightly, the rotation of the rotatable roller 62 permits the cylindrical member 61 to be displaced to its phantom line position shown in FIG. 7. In this embodiment, when the cylindrical member 61 assumes its positions shown in solid line and in phantom lines, it is assured by the spring 65 that the anti-reversing pawls 46, 47 be engaged with one of the teeth on the associated ratchet wheels 14, 15 during a normal ribbon feed operation.

What is claimed is:

1. An ink ribbon feeder for causing a reciprocating movement of an ink ribbon between a pair of spools; comprising a baseplate;

a pair of ratchet wheels rotatably mounted on the baseplate for driving the spools;

a control member located intermediate the pair of ratchet wheels and supported on the baseplate so as to be movable in a direction perpendicular to a line joining the axes of the pair of ratchet wheels and so as to permit one end thereof to be rockable toward either ratchet wheel;

a ratchet wheel drive member carried by one end of the control member, the ratchet wheel drive member having one end which is disposed centrally in one end of the control member so as to be rockable and so as to be movable in a direction toward the other end of the control member, the other end of the ratchet wheel drive member selectively engaging with a tooth on a respective one of the ratchet wheels and being formed with an engaging portion which causes said one ratchet wheel to rotate when the control member rocks toward said one ratchet wheel;

a resilient member having its one end connected to a central portion of the other end of the ratchet wheel drive member and its other end connected to a central portion of the other end of the control member, thereby urging the ratchet wheel drive member toward the other end of the control member;

a switching lever having a pair of anti-reversing pawls on one end thereof which selectively engage a tooth on a respective one of the pair of ratchet wheels to prevent a reverse rotation of the engaged ratchet wheel, the switching lever being pivotally mounted on the baseplate intermediate its ends, one end of the switching lever carrying said one end of the control member so as to be movable in said perpendicular direction and so as to be rockable whenever the control member rocks in the same direction as the rocking motion of the control member;

means on the other end of the switching lever for selectively urging said one end of the switching lever toward one of the ratchet wheels said urging means acting, whenever the center of said one end of the switching lever has rocked toward either ratchet wheel from a line which perpendicularly intersects with said first mentioned line at a point midway between the pair of ratchet wheels, to cause said one end of the switching lever to rock toward the ratchet wheel;

a drive member for moving the control member in said perpendicular direction;

means for driving the drive member to urge the control member in one direction, the engaging element of the ratchet wheel drive member being engaged with one of the ratchet wheels when the urging means urges the control member in said one direction; and wherein the other end of the ratchet wheel drive member is provided with a projection on its bottom surface, and the control member has a guide slot in which the projection on the ratchet wheel drive member bottom surface loosely fits, the guide slot including a rectilinear slot portion which guides the drive member for movement in said direction, and the guide slot including an arcuate slot portion having a central portion connected with one end of the rectilinear slot portion for guiding the drive member for rocking motion.

2. An ink ribbon feeder according to claim 1 in which an upright pin is provided on said one end of the control member and is loosely fitted in an elongate slot formed centrally in said one end of the ratchet wheel drive member, the elongate slot extending toward the other end of the ratchet wheel drive member for allowing the latter to rock about the upright pin.

3. An ink ribbon feeder according to claim 1 in which said urging means comprises a bias spring having its one end connected to the other end of the switching lever and its other end anchored to the baseplate in a manner such that the magnitude of the bias is at its maximum when the center of said one end of the switching lever is located midway between the pair of ratchet wheels.

4. An ink ribbon feeder according to claim 1 in which the urging means comprises a cylindrical member mounted on the other end of the switching lever, a pivotable arm having its one end pivotally mounted on the baseplate, a rotatable roller rotatably carried by the other end of the pivotable arm, and a resilient member for urging the rotatable roller so that its peripheral surface is normally maintained in contact with the peripheral surface of the cylindrical member, the rotatable member being positioned such that an elongation of the resilient member is at its maximum when the center of said one end of the switching lever is located midway between the pair of ratchet wheels.

* * * * *